US005385236A

United States Patent [19]

Cowan et al.

[11] Patent Number: 5,385,236

[45] Date of Patent: Jan. 31, 1995

[54] ARTICULATED EDGE GUARD PROTECTOR

[76] Inventors: John D. Cowan, 2436 Brixton Rd., Columbus, Ohio 43221; Roger A. Bleim, 2957 N. Island Cir., Port Clinton, Ohio 43452

[21] Appl. No.: 254,341

[22] Filed: Jun. 6, 1994

[51] Int. Cl.[6] ..... B65D 81/02; B65D 85/30

[52] U.S. Cl. ..... 206/453

[58] Field of Search ..... 206/453, 586; 248/345.1; 428/81, 83

[56] References Cited

U.S. PATENT DOCUMENTS

| | | | |
|---|---|---|---|
| 4,063,702 | 12/1977 | Wilde et al. | 206/586 X |
| 4,153,230 | 5/1979 | Giacin | 206/586 X |
| 4,407,898 | 10/1983 | Kato et al. | 206/453 X |
| 4,742,916 | 5/1988 | Galea | 206/586 |
| 4,871,063 | 10/1989 | Kumbier | 206/453 X |
| 4,877,673 | 10/1989 | Eckel et al. | 206/586 X |
| 5,065,972 | 11/1991 | Buckshaw et al. | 248/345.1 |
| 5,114,010 | 5/1992 | Smith | 206/453 |

FOREIGN PATENT DOCUMENTS

| | | |
|---|---|---|
| 1939316 | 2/1971 | Germany . |
| 2024331 | 12/1971 | Germany . |
| 2060626 | 6/1972 | Germany . |
| 3718326 | 12/1988 | Germany . |

*Primary Examiner*—Jacob K. Ackun, Jr.
*Attorney, Agent, or Firm*—John L. Gray

[57] ABSTRACT

Applicants' articulated edge guard protector utilizes a combination of relatively soft members which come in contact with the tie-down strap, chain, rope and the like, yet is maintained in place because such softer compressible members are combined with hard members which maintain the desired shape of the articulated edge guard protector and also additionally provide protection to the item being shipped.

6 Claims, 2 Drawing Sheets

ARTICULATED EDGE GUARD PROTECTOR

In shipping various items by truck or rail, it is often necessary to secure the goods being shipped by a tie-down such as a chain, rope, plastic strapping or similar material. Such tie-downs damage the edges of the article being shipped. Consequently, various devices are used to protect the edges from damage from the tie-down material. These include pieces of wood, rubber sheets, pressed board, plastic devices, built-up solid fiber shapes, and the like. All of these devices that are preformed are rigid and formed to a 90° angle. There are two general problems with these devices. The first is that they can only effectively protect items which have an edge essentially conforming to the 90° angle of the edge guard. In addition, special molding or construction considerations are required to restrain the securing devices from slipping off the edge guard as a result of vibrations induced during the handling and transportation of the items being protected. As far as applicant has been able to determine, there are no edge guards in the prior art that provide both a surface friction gripping action to prevent sliding of the tie-down materials and shifting of the edge guard on the item to be protected. In addition, any edge guard that is required for edges that are other than essentially a 90° angle require custom construction.

Furthermore, if the item to be protected needs essentially a soft surface contact with the edge guard, this is not possible with preformed materials that are currently available because of the hard composition of such edge guard material.

In addition, the edge guard devices that are currently available do not provide for minimum surface contact of the item being protected when this is a desirable characteristic and usually requires significant additional inventory for various lengths and leg sizes needed.

Moreover, the current preformed devices available are not useful for inside and outside radius edge protection requirements because of the inflexibility of the existing edge protection devices.

SUMMARY OF THE INVENTION

Applicants' articulating edge guard protector overcomes these undesirable features by utilizing a combination of a relatively soft member which comes in contact with the tie-down strap, chain, rope and the like, yet is maintained in place because such softer compressible members are combined with hard members which maintain the desired shape of the articulated edge guard protector and also additionally provide protection to the item being shipped.

In addition, applicants' invention is waterproof, it will not delaminate, it inhibits bacteria growth, and it will not absorb contaminants, either by contact or exposure.

Applicants' device can be used at a variety of angles in addition to 90°, depending upon the particular needs, and is adaptable for use with inside and outside radii.

Furthermore, the compressible portions of the device as well as the initial angle possess memory so that when removed from the particular application may be used over again and do not acquire a permanent set.

It is therefore an object of this invention to provide an articulated edge guard protector which may be used in a variety of applications for protection of material being shipped.

It is an additional object of this invention to provide such an edge guard protector which may be used to protect edges other than 90° as well as a 90° edge and also which may be readily cut to a particular size for particular applications.

These, together with other objects and advantages of the invention will become more readily apparent to those skilled in the art when the following general statements and descriptions are read in light of the appended drawings.

DETAILED DESCRIPTION OF THE INVENTION

Figure 1:
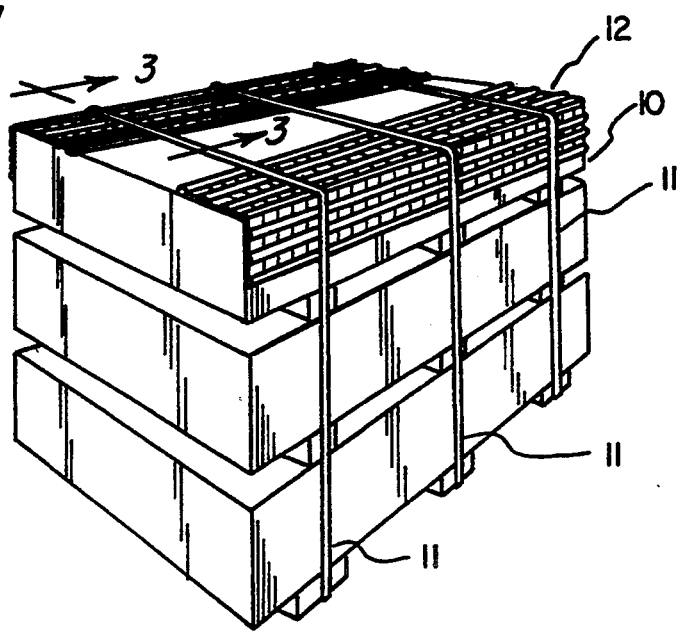
FIG. 1 is a typical pallet-type load of materials showing applicants' articulated edge guard protector in use.

Referring to the drawings and especially to FIG. 1, there is shown a typical shipment 10 which is held in place by tie-down straps 11—11. In this case, applicants' articulated edge guard protector 12 is shown running the entire length of the shipment 10 being protected. It should be understood, of course, that applicants' articulated edge guard protector may be readily cut so that a portion would be in place only where straps 11—11 pass over the edge of the shipment 10 being shipped.

Figure 2:
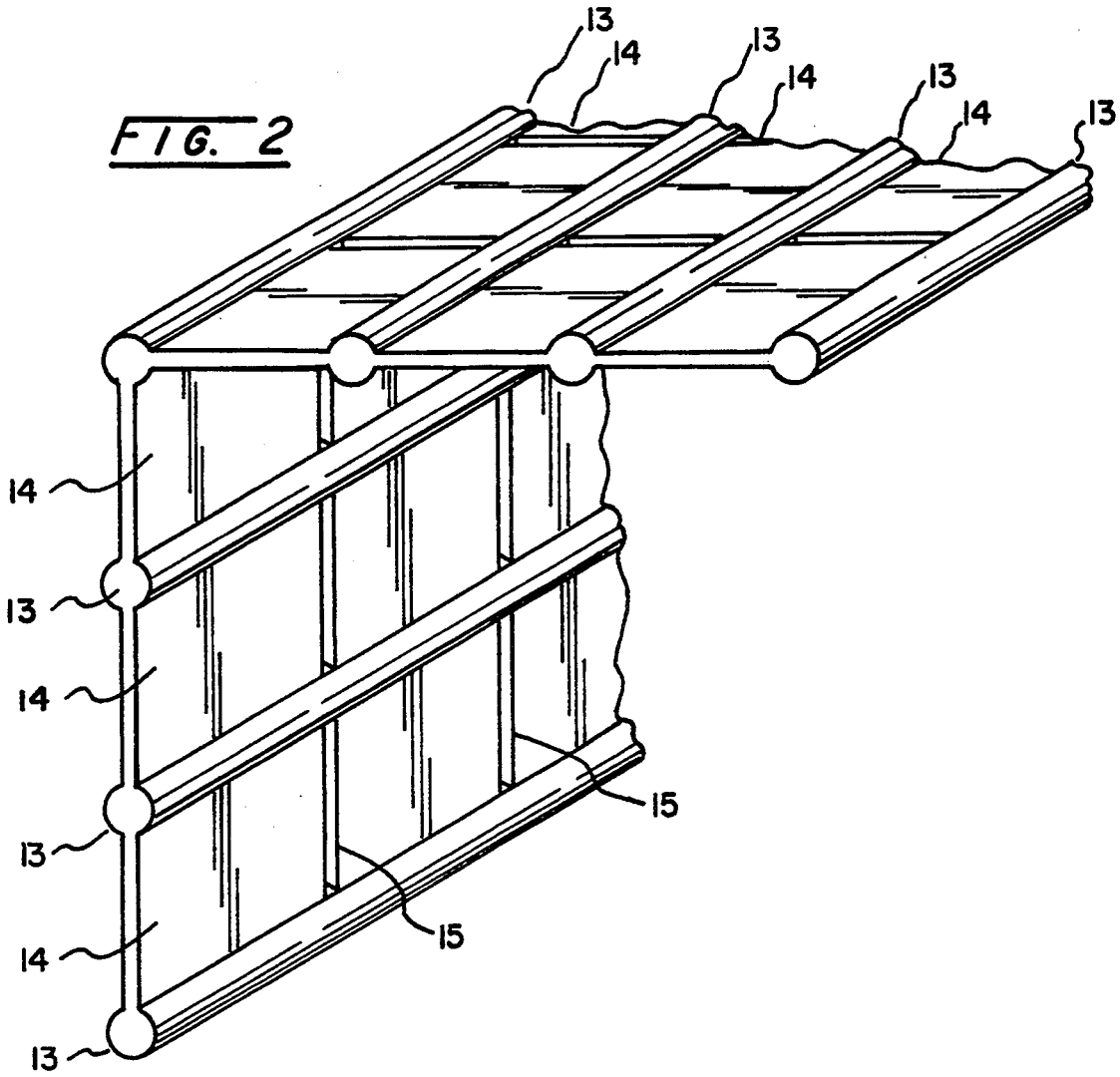
FIG. 2 is a perspective view of applicants' articulated edge guard protector.

Referring now more particularly to FIG. 2, which is a perspective view of applicants' articulated edge guard protector, it will be seen that there are cylindrical members 13—13 which are made from a soft thermoplastic such as low density polyethylene, and the webbing 14, which is made from a rigid thermoplastic material such as high density polypropylene, of which the cylindrical members 13—13 form a part. One of the cylindrical members 13 forms the corner of the 90° angle shown. It should be remembered, however, that because of the nature of the thermoplastic material selected, this edge guard protector may be shaped to conform to various edges.

Also shown in FIG. 2 are slots 15—15 which are spaced apart and at right angles to the cylindrical members 13—13, which enable the articulated edge guard protector to be readily cut into various shorter pieces, the width depending upon the particular application. Since the cylindrical members 13—13 are made of a softer thermoplastic material than the webbing 14, when the strap 11 is tightened down the members 13—13 will deform and thus not only protect the shipment 10 but will also prevent the strap from sliding along the cylindrical member 13 because of the deformity achieved.

Figure 3:
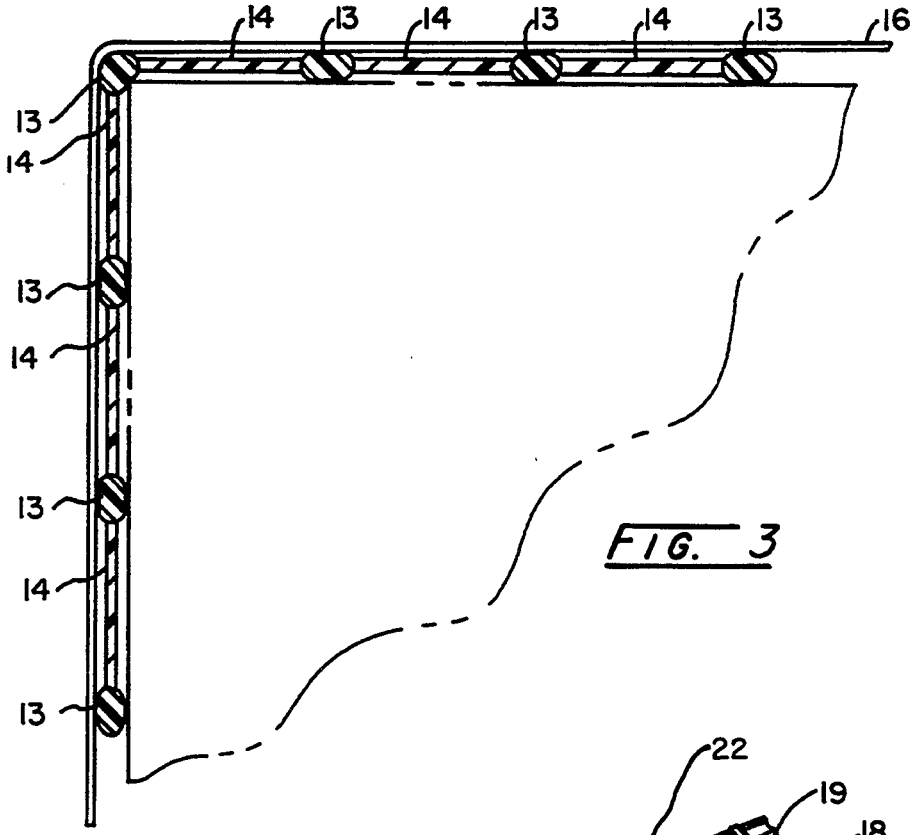
FIG. 3 is a side sectional view on section 3—3 of FIG. 1 showing a cross section of applicants' articulated edge guard protector positioned on goods being shipped and held in place by a conventional tie-down strap.

Referring now more particularly to FIG. 3, which is a sectional view on the plane 3—3 of FIG. 1, the shipment 10 is secured by the strapping 16 and each of the cylindrical members 13—13 are shown in a deformed position since the strapping 16 has been pulled very tightly over them, illustrating the special advantage of applicants' articulated edge guard protector in preventing the strapping 16 from sliding along the length of the cylindrical members 13—13.

Figure 4:
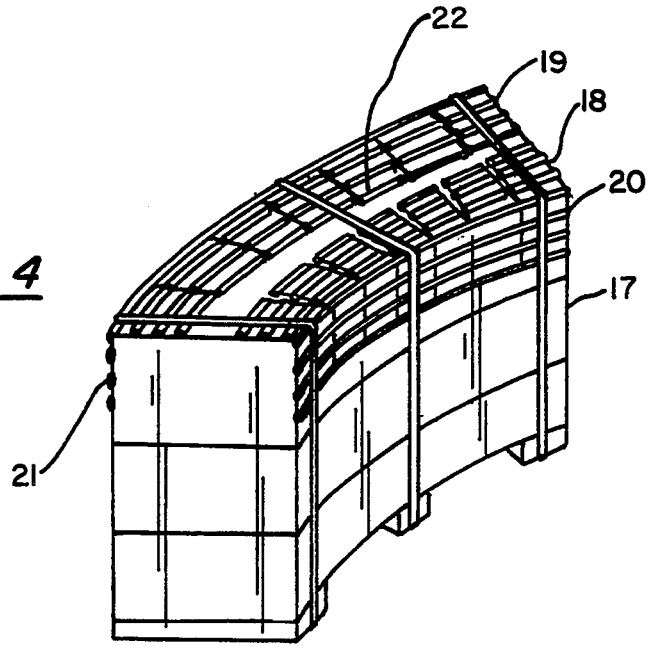
FIG. 4 illustrates the use of applicants' articulated edge guard protector on both inside and outside radii.

FIG. 4 shows a particularly curved shaped shipment 17 being held down by applicants' articulated edge guard protectors as shown at 18 on the inner radius and 19 on the outer radius. These particular articulated edge guard protectors have been cut in each instance along the lines 15—15 so as to be able to conform to the inner radius at 20 of this particular piece of goods and also conform to the outer radius at 21 with slight overlap of the ends of the edge guard protectors as shown at 22, for example.

Figure 5:
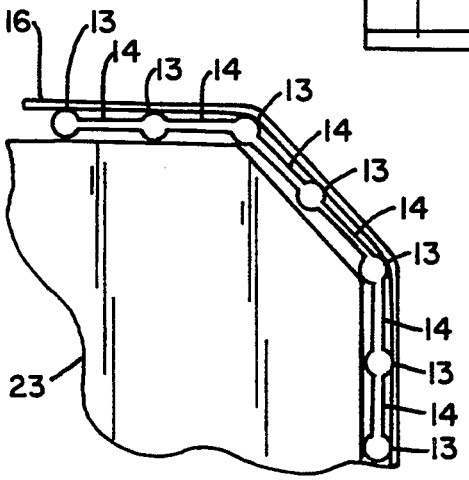
FIG. 5 shows the versatility of applicants' articulated edge guard protector on a multi-angle edge.

FIG. 5 shows the way in which the articulated edge guard protector of this invention may be shaped over a shipment 23 having a double corner and being held down by strap 16 thus showing the versatility of applicants' articulated edge guard protector.

By the use of this invention, a soft and nonabrasive surface contact is provided to any shipment that is being protected. In addition, this also provides cushioning to the item to be protected as well as to adjacent items that may be impacted or abraded due to proximity to the shipment being protected. The cylinders 13—13 also provide an additional function in that they permit air to flow between the articulated edge guard protector and the shipment which it is protecting, thus avoiding moisture build-up, dirt accumulation and the resultant staining and discoloration.

While this invention has been described in its preferred embodiment, it is to be appreciated that variations therefrom may be made without departing from the true scope and spirit of the invention.

What is claimed:

1. An articulated edge guard protector comprising two planar members, each of said planar members being made from a relatively rigid thermoplastic material, said planar members being joined together and forming essentially a right angle with each other at the joint formed by joining said planar members together, a substantially cylindrical member made from a softer thermoplastic material than the material from which said planar members are made and attached to and extending along and constituting a part of said joint formed by joining said planar members together, said cylindrical member being of a diameter such that a portion of said cylindrical member extends above the surface of said planar members.

2. The articulated edge guard protector of claim 1 wherein said planar members are rectangular in shape.

3. The articulated edge guard protector of claim 2 wherein each of said planar members are provided with at least one additional cylindrical member spaced from and parallel to said substantially cylindrical member of claim 1, said additional cylindrical members extending above the surface of said planar members.

4. The articulated edge guard protector of claim 3 wherein said rectangular members are provided with a perforated line parallel to one side of said rectangular planar members and at right angles to said cylindrical members which may be readily cut open for particular applications of the articulated edge guard protector.

5. The articulated edge guard protector of claim 1 wherein said relatively rigid thermoplastic material from which said planar members are made is high density polypropylene.

6. The articulated edge guard protector of claim 1 wherein said softer thermoplastic material from which said substantially cylindrical member is made is low density polyethylene.

* * * * *